US008843039B2

(12) United States Patent
Namba

(10) Patent No.: US 8,843,039 B2
(45) Date of Patent: Sep. 23, 2014

(54) IMAGE FORMING APPARATUS WITH HIGH-RESISTANCE LAYER AND VOLTAGE APPLICATION UNIT

(75) Inventor: Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

(21) Appl. No.: 13/212,551

(22) Filed: Aug. 18, 2011

(65) Prior Publication Data

US 2012/0219333 A1 Aug. 30, 2012

(30) Foreign Application Priority Data

Feb. 25, 2011 (JP) ..... 2011-040546

(51) Int. Cl.
*G03G 15/20* (2006.01)
*G03G 15/16* (2006.01)

(52) U.S. Cl.
CPC ..... *G03G 15/1675* (2013.01); *G03G 15/162* (2013.01); *G03G 15/1685* (2013.01)
USPC ..... 399/313

(58) Field of Classification Search
USPC ..... 399/310, 313, 314
See application file for complete search history.

(56) References Cited

U.S. PATENT DOCUMENTS

| | | | | |
|---|---|---|---|---|
| 5,768,653 | A * | 6/1998 | Fare | 399/313 X |
| 2008/0057289 | A1 * | 3/2008 | Ichikawa | 428/304.4 |
| 2009/0208259 | A1 * | 8/2009 | Ishikawa | 399/313 |

FOREIGN PATENT DOCUMENTS

| | | | |
|---|---|---|---|
| JP | 09-034278 | * | 2/1997 |
| JP | A-2004-245933 | | 9/2004 |

* cited by examiner

*Primary Examiner* — Sandra Brase
(74) *Attorney, Agent, or Firm* — Oliff PLC

(57) ABSTRACT

An image forming apparatus includes a transfer member that has a core and a high-resistance layer; a facing member that is arranged to face the transfer member so as to sandwich an object to be transferred in cooperation with the transfer member; a contact member that is arranged so as to be capable of contacting the transfer member; and a voltage application unit that applies a voltage between the contact member and the facing member, to pass a transfer current between the transfer member and the facing member, such that the core is electrically floated.

11 Claims, 8 Drawing Sheets

IMAGE FORMING APPARATUS WITH HIGH-RESISTANCE LAYER AND VOLTAGE APPLICATION UNIT

CROSS-REFERENCE TO RELATED APPLICATIONS

This application is based on and claims priority under 35 USC 119 from Japanese Patent Application No. 2011-040546 filed Feb. 25, 2011.

BACKGROUND

Technical Field

The present invention relates to an image forming apparatus.

SUMMARY

According to an aspect of the invention, there is provided an image forming apparatus including a transfer member that has a core and a high-resistance layer; a facing member that is arranged to face the transfer member so as to sandwich an object to be transferred in cooperation with the transfer member; a contact member that is arranged so as to be capable of contacting the transfer member; and a voltage application unit that applies a voltage between the contact member and the facing member, to pass a transfer current between the transfer member and the facing member, such that the core is electrically floated.

BRIEF DESCRIPTION OF THE DRAWINGS

Exemplary embodiments of the present invention will be described in detail based on the following figures, wherein.

DETAILED DESCRIPTION

An example of an image forming apparatus related to an exemplary embodiment of the invention will be described with reference to FIGS. 1 to 8.

(Overall Configuration)

Figure 5:
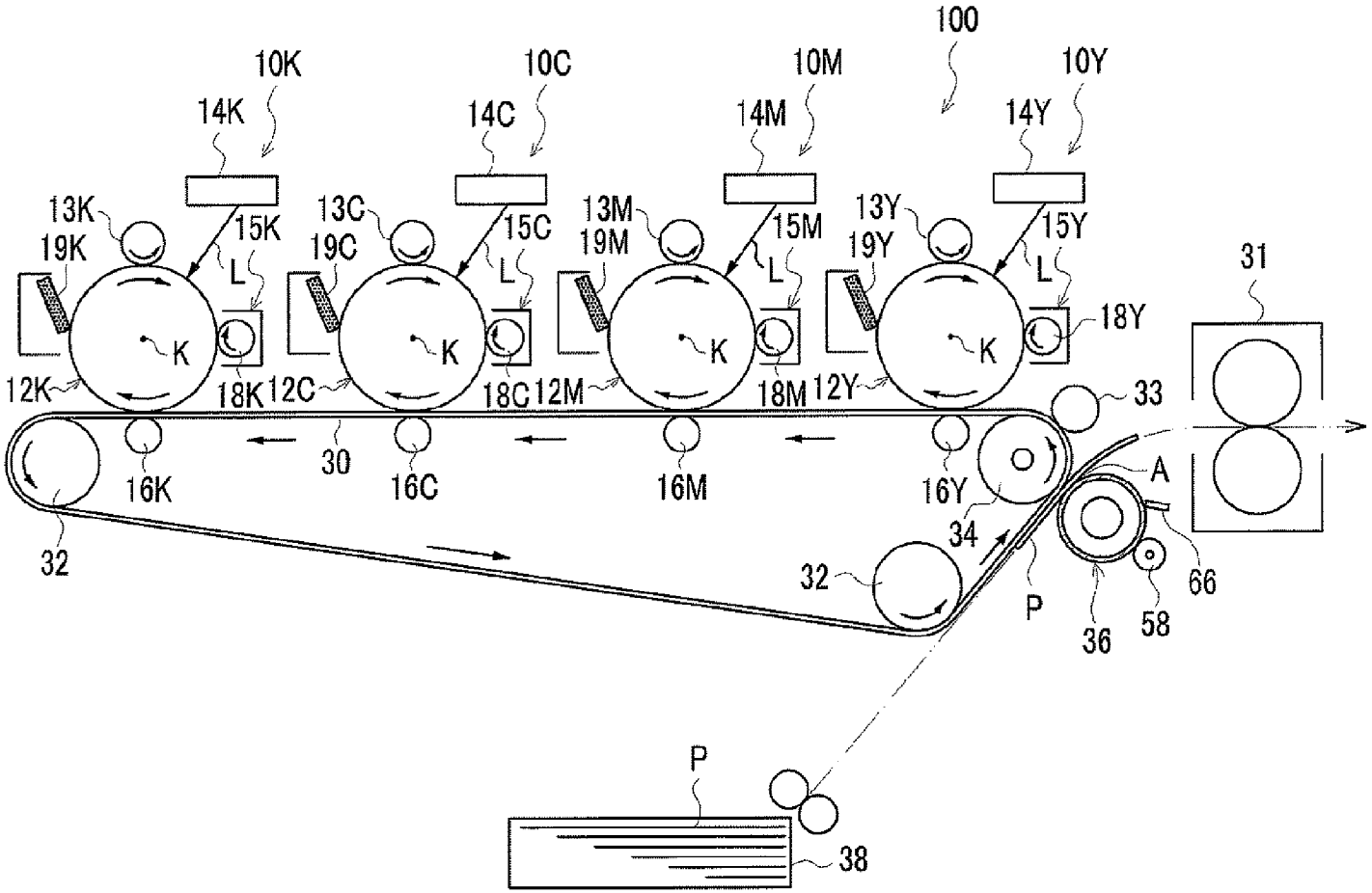
FIG. 5 is a schematic configuration view showing the image forming apparatus related to the exemplary embodiment of the invention.

As shown in FIG. 5, an image forming apparatus 100 includes image forming units 10Y, 10M, 10C, and 10K that form toner images of respective colors of yellow (Y), magenta (M), cyan (C), and black (K). In addition, description will be made below with any of Y, M, C, and K given to the end of a symbol when YMCK needs to be distinguished from one another, and Y, M, C, and K will be omitted when YMCK do not need to be distinguished from one another.

The image forming units 10Y, 10M, 10C, and 10K are arranged in series in order of the image forming units 10Y, 10M, 10C, and 10K in the traveling direction of an endless intermediate transfer belt 30 wound around a back-up roller 34 as an example of a facing member, and plural tension rollers 32.

Primary transfer rollers 16Y, 16M, 16C, and 16K, which transfer respective color toner images formed on the surfaces of image carriers 12 to the intermediate transfer belt 30, are provided opposite the image carriers 12Y, 12M, 12C, and 12K provided in the image forming units 10Y, 10M, 10C, and 10K, respectively, across the intermediate transfer belt 30. In detail, transfer bias voltages are applied to the primary transfer rollers 16Y, 16M, 16C, and 16K, and respective color toner images are primarily transferred to the intermediate transfer belt 30 sequentially by electrostatic attractive forces.

Next, an image forming unit 10Y, which forms a yellow toner image on behalf of the configuration of the respective image forming units 10Y, 10M, 10C, and 10K, will be described. In addition, the respective image forming units 10 have the same configuration.

A charging roller 13Y, which uniformly charges the surface of the image carrier 12Y in contact with the surface of the image carrier 12Y and rotates to follow the rotation of the image carrier 12Y, is provided opposite the image carrier 12Y across the intermediate transfer belt 30.

Moreover, an exposure device 14Y is provided to expose the surface of the charged image carrier 12Y with exposure light and forms an electrostatic latent image corresponding to a yellow image.

Additionally, the developing device 15Y, which develops the electrostatic latent image formed by the exposure device 14 to form a yellow toner image, is provided on the downstream side of the charging roller 13Y in the rotational direction of the image carrier 12Y. In detail, the developing device 15Y is provided with a developing roller 18Y that rotates to relate the rotation of the image carrier 12Y. Also, a toner charged with a negative voltage attaches to the electrostatic latent image formed on the surface of the image carrier 12Y from the outer peripheral surface of the developing roller 18Y so as to visualize (develop) the electrostatic latent image as a yellow toner image. As mentioned above, toner images formed on the surfaces of the respective image carriers 12 are sequentially transferred to the intermediate transfer belt 30 by the respective primary transfer rollers 16.

Moreover, a blade 19Y, which scrapes off the residual toner, which remains without being transferred to the intermediate transfer belt 30 from the surface of the image carrier 12Y, from the surface of the image carrier 12Y, is provided on the upstream side of the charging roller 13Y in the rotational direction of the image carrier 12Y.

On the other hand, a secondary transfer roller 36 as an example of a transfer member is provided opposite the back-up roller 34 across the intermediate transfer belt 30. The secondary transfer roller 36 nips and conveys a sheet member P conveyed from a sheet supply section 38 on which the sheet member P as an object to be transferred is stacked between the secondary transfer roller 36 and the intermediate transfer belt 30, and the toner images formed on the intermediate transfer belt 30 are transferred to the sheet member P. In addition, the secondary transfer roller 36 including an application method of a transfer bias voltage or the like will be described below in detail.

Moreover, a fixing device 31, which fixes the toner images transferred to the sheet member P by heat and pressure onto the sheet member P, is provided on the downstream side of the secondary transfer roller 36 in the conveying direction of the sheet member P.

On the other hand, a cleaning roller 33, which cleans the residual toner that has not been transferred to the sheet member P from the intermediate transfer belt 30, is provided opposite the back-up roller 34 across the intermediate transfer belt 30.

When the image forming apparatus 100, as shown in FIG. 5, is operated according to the above configuration, the surface of the image carrier 12 for each color is uniformly charged by the charging roller 13. Next, the charged image carrier 12 is irradiated with exposure light by the exposure device 14 for each color, and an electrostatic latent image corresponding to each color toner image is formed on the surface of the image carrier 12.

Moreover, each color toner to which a developing bias has been applied transfers to the electrostatic latent image formed on the surface of the image carrier 12 for each color from the outer peripheral surface of the developing roller 18, and an electrostatic latent image in each color is made visible (developed) as a toner image.

Additionally, the toner images formed on the surfaces of the image carriers 12 for the respective colors are primarily transferred onto the intermediate transfer belt 30 sequentially by the contact pressure of the primary transfer rollers 16, and the electrostatic attractive forces by the transfer bias voltages applied to the primary transfer rollers 16. That is, toner images in respective colors of Y, M, C, and K are sequentially superimposed on the intermediate transfer belt 30, thereby forming a multi-toner image (for example, a color toner image).

Then, the multi-toner image formed on the intermediate transfer belt 30 is conveyed to a position that faces the secondary transfer roller 36 by the intermediate transfer belt 30 that goes around the secondary transfer roller.

The secondary transfer roller 36 nips and conveys a sheet member P conveyed from the sheet supply section 38 on which the sheet member P is stacked between itself and the intermediate transfer belt 30, and the toner images conveyed to a position that faces the secondary transfer roller 36 is transferred to the sheet member P.

After the sheet member P to which the toner images have been transferred is separated from the intermediate transfer belt 30, the sheet member is conveyed to the fixing device 31, the toner images are fixed onto the sheet member P by heat and pressure, and the sheet member is ejected to an ejection section (not shown).

(Configuration of Relevant Parts)

Next, the secondary transfer roller 36, an application method of a transfer bias voltage, and the like will be described.

Figure 1:
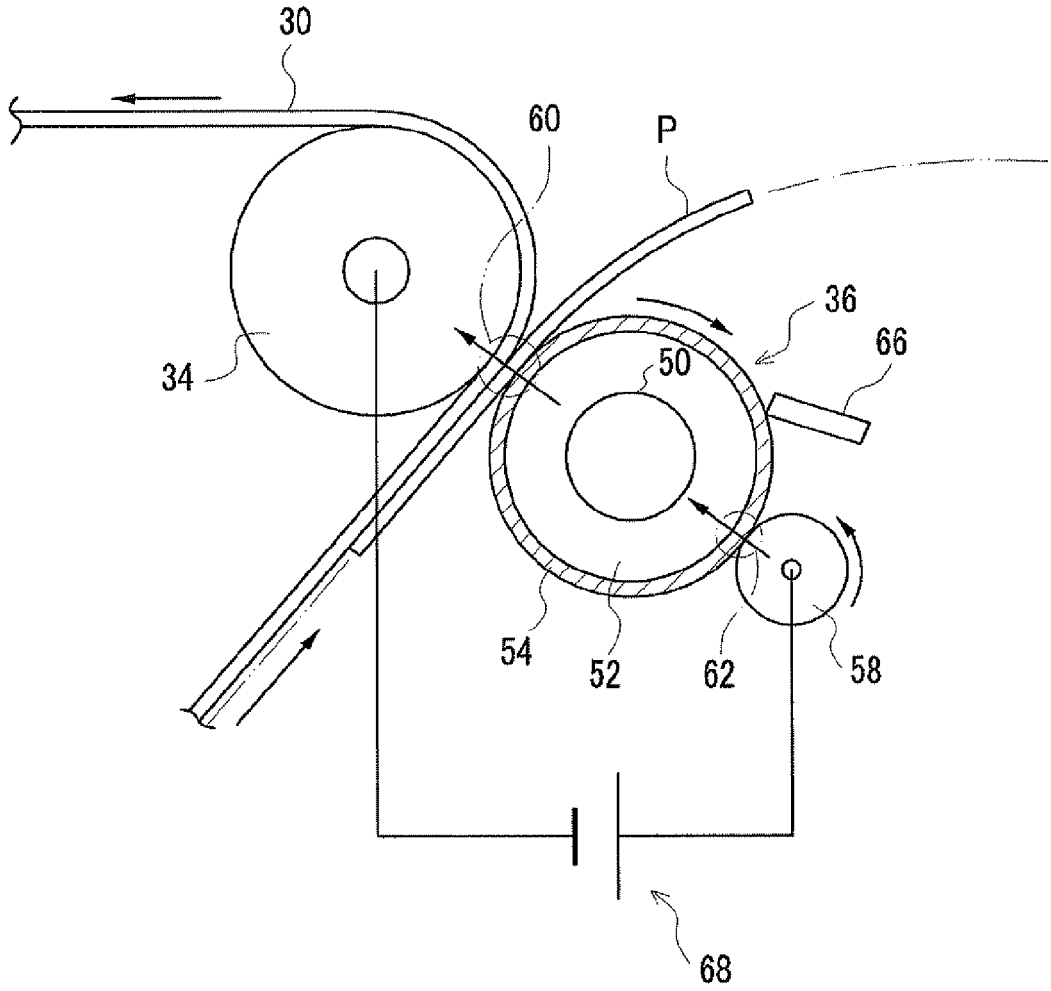
FIG. 1 is a side view showing the vicinity of a secondary transfer roller provided in an image forming apparatus related to an exemplary embodiment of the invention.

As shown in FIG. 1, the secondary transfer roller 36 that is rotated by a driving force is transmitted thereto from a motor (not shown) includes a columnar core 50 of which the diameter is 14 mm and that becomes a rotary shaft, an elastically deformable elastic layer 52 that is provided at the outer peripheral surface of the core 50, and a high-resistance layer 54 that is provided on the surface of this elastic layer. The high-resistance layer 54 is a layer formed from a high-resistance member used in order to suppress flow of a transfer current to the outside in the direction of the rotary shaft of the secondary transfer roller 36 by the resistance of a toner image or the sheet member P that passes between itself and the back-up roller 34. As an example, in the present exemplary embodiment, a polyimide layer (PI layer) that has a thickness of 0.05 mm and a resistance of $10^{13.7}$ Ω·cm at the measurement of 100 V is used. The external diameter of the secondary transfer roller 36 is 28 mm. Moreover, the circumferential speed of the secondary transfer roller 36 is set to 900 mm/s from the relationship with the circumferential speed of the intermediate transfer belt 30.

In addition, as the present exemplary embodiment, as an example, SUS is used as the material of the core 50, and a low-resistance and low-hardness urethane foaming layer is used as the elastic layer 52.

Moreover, a columnar conductive member 58 that rotates to follow the rotation of the secondary transfer roller 36 and has conductivity is provided opposite the intermediate transfer belt 30 across the secondary transfer roller 36.

Additionally, a cleaning blade 66, which cleans the outer surface of the secondary transfer roller 36 in contact with the outer surface of the secondary transfer roller 36, is provided on the downstream side of a facing portion 60 where the secondary transfer roller 36 and the back-up roller 34 face each other, in the rotational direction of the secondary transfer roller 36. And a cleaning blade 66 is provided on the upstream side of a contact portion 62 between the secondary transfer roller 36 and the conductive member 58 in the rotational direction of the secondary transfer roller 36.

Moreover, a power source 68 as an example of a voltage application unit, which applies a voltage between the conductive member 58 and the back-up roller 34 and passes a transfer current between the secondary transfer roller 36 and the back-up roller 34, is provided such that the core 50 is electrically floated.

Here, the "electrically floated" means a state (a non-grounded state) where a voltage is not applied and a voltage does not escape.

(Action of Configuration of Relevant Parts)

Next, the action of transferring a toner image formed on the intermediate transfer belt 30 to a sheet member P will be described.

As shown in FIG. 1, first, a voltage is applied between the conductive member 58 and the back-up roller 34 by the power source 68 such that the core 50 is electrically floated (in the present exemplary embodiment, a positive voltage is applied to the conductive member 58 side).

Thereby, as indicated by an arrow in the drawing, in the contact portion 62, a current flows to the secondary transfer roller 36 from the conductive member 58. Moreover, in the facing portion 60, a current (transfer current) flows to the back-up roller 34 through the sheet member P and the intermediate transfer belt 30 from the secondary transfer roller 36.

A toner image formed on the intermediate transfer belt 30 and charged with a negative voltage is transferred to the sheet member P by an electrostatic attractive force as a transfer current flows to the back-up roller 34 from the secondary transfer roller 36.

Figure 2:
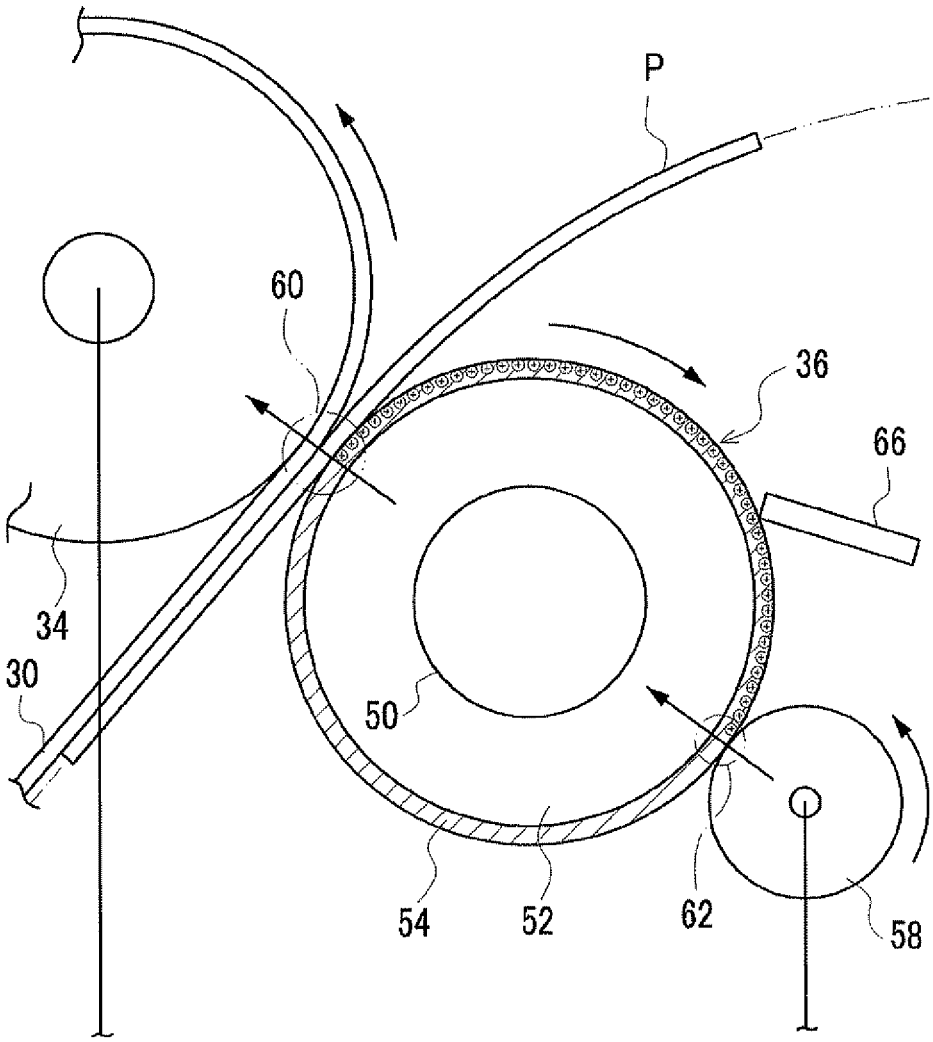
FIG. 2 is a side view showing the vicinity of the secondary transfer roller provided in the image forming apparatus related to the exemplary embodiment of the invention.

Here, as shown in FIG. 2, in the high-resistance layer 54 of the facing portion 60, the high-resistance layer 54 is formed from a high-resistance member. Therefore, electric discharge is suppressed, and the high-resistance layer 54 of the facing portion 60 is charged with a positive voltage. A charged portion of the high-resistance layer 54 moves to the downstream side in the rotational direction of the secondary transfer roller 36 with the rotation of the secondary transfer roller 36. Also, in the contact portion 62, a current flows to the secondary transfer roller 36 from the conductive member 58. Therefore, the charging occurred in the high-resistance layer 54 is neutralized.

Moreover, a neutralized portion neutralized in the high-resistance layer 54 moves to the downstream side in the rotational direction of the secondary transfer roller 36 with the rotation of the secondary transfer roller 36. In the facing portion 60, as mentioned above, the high-resistance layer 54 of the facing portion 60 is charged with a positive voltage.

In this way, since the high-resistance layer 54 that moves to the facing portion 60 with the rotation of the secondary transfer roller 36 is neutralized (not charged) in the contact portion 62, a transfer current that flows between the secondary transfer roller 36 and the back-up roller 34 by application of a fixed voltage becomes constant.

Figure 3:
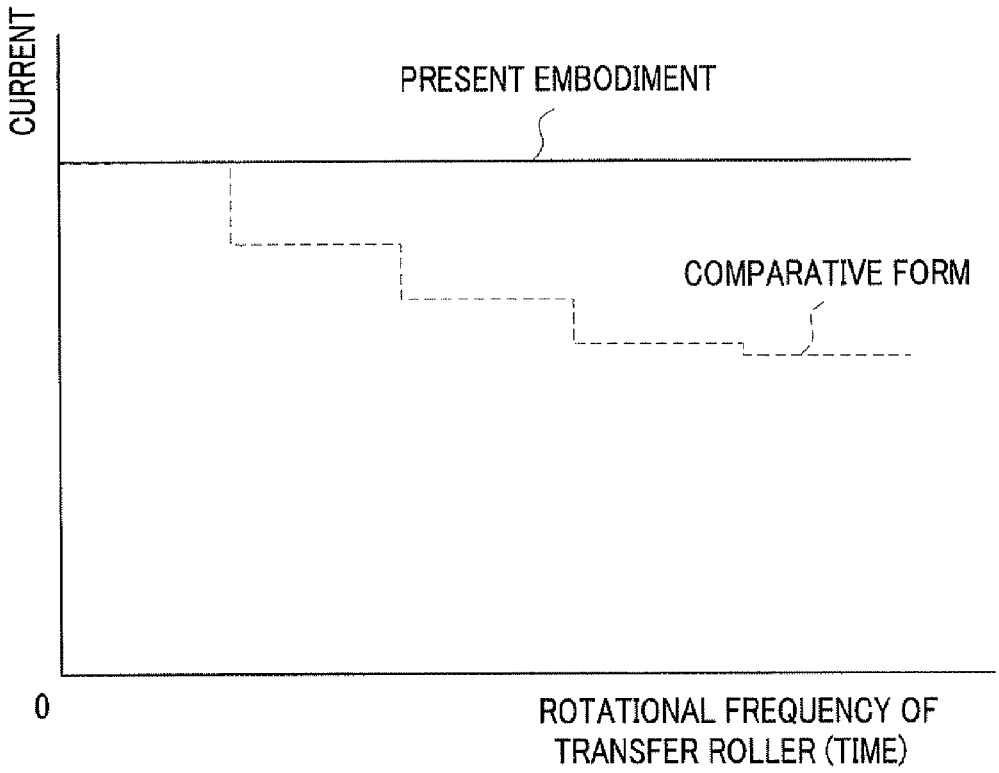
FIG. 3 is a graph showing the transfer current of the image forming apparatus related to the exemplary embodiment of the invention and the transfer current of an image forming apparatus related to a comparative form.

A graph where the vertical axis represents the current and the horizontal axis represents the rotational frequency (time) of the secondary transfer roller is shown in FIG. 3. When the transfer current of the present exemplary embodiment is plotted on this graph, the fluctuation of the transfer current is suppressed irrespective of the passage of time.

Here, a current that flows to the facing portion 60, and time are evaluated. As for an evaluation method, a current that flows to the facing portion 60 is evaluated by applying a voltage of +2200 V for a certain period of time by the power source 68, then setting the voltage to 0 V for a certain period of time, and then applying a voltage of −2200 V for a certain period of time such that a current of ±200 μA is passed to the facing portion 60.

Figure 4:
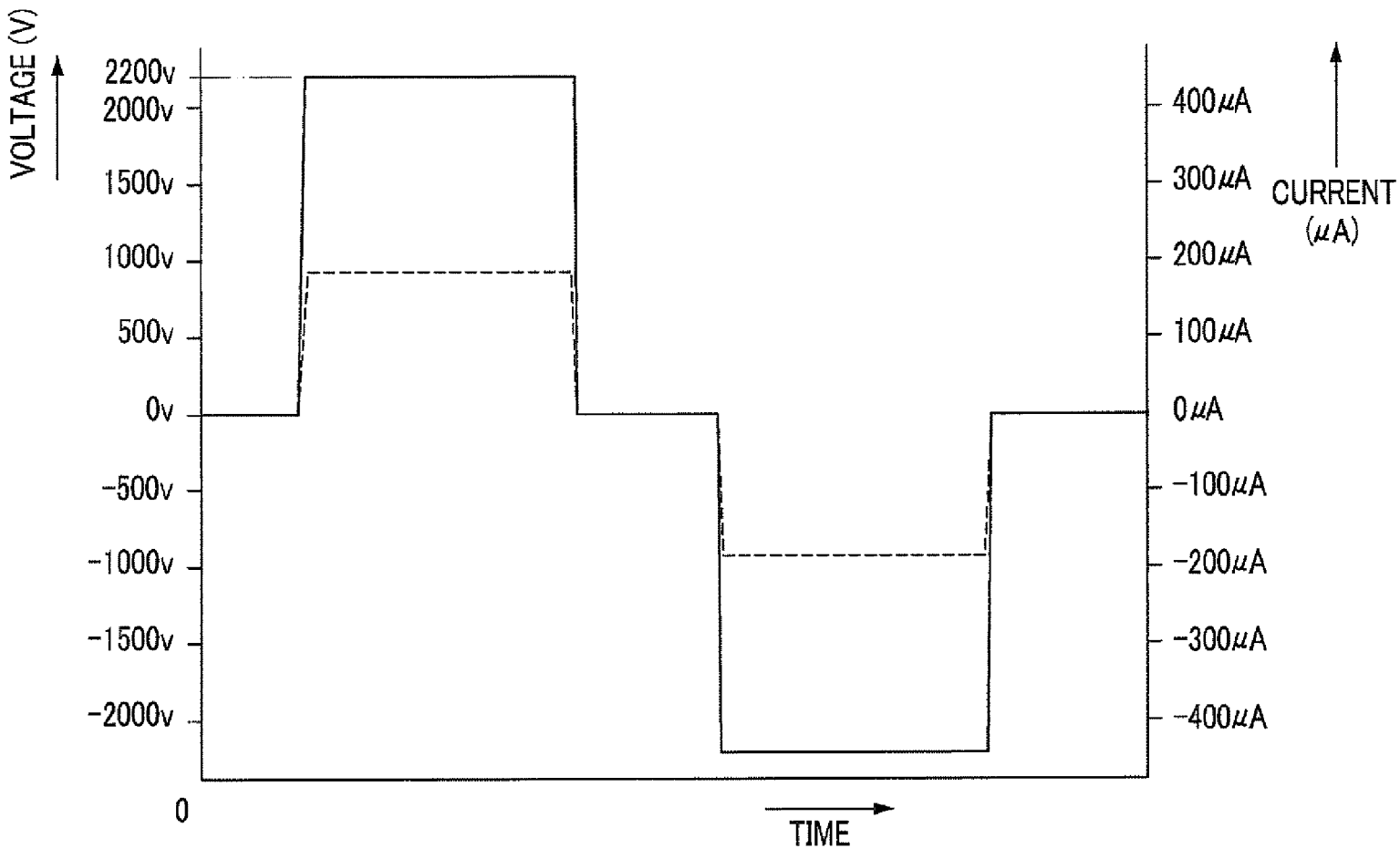
FIG. 4 is a graph showing the applied voltage and current of the image forming apparatus related to the exemplary embodiment of the invention.

A graph where the vertical axis represents voltage (V) and current (μA) and the horizontal axis represents time is shown in FIG. 4. In this graph, the voltage is shown by a solid line, and the current as the evaluation results is shown by a dotted line. As can be seen from the evaluation results shown in this graph, it turns out that the current of +200 μA flows almost constantly when the voltage of +2200 V is applied by the power source 68, the current becomes 0 μA when the voltage is set to 0 V, and the current of −200 μA flows almost constantly when the voltage of −2200 V is applied. That is, it turns out that the fluctuation of the current is suppressed even if the level of a voltage to be applied is changed.

On the other hand, as a comparative example of the present exemplary embodiment, a configuration that does not use the conductive member 58 is evaluated.

Figure 6:
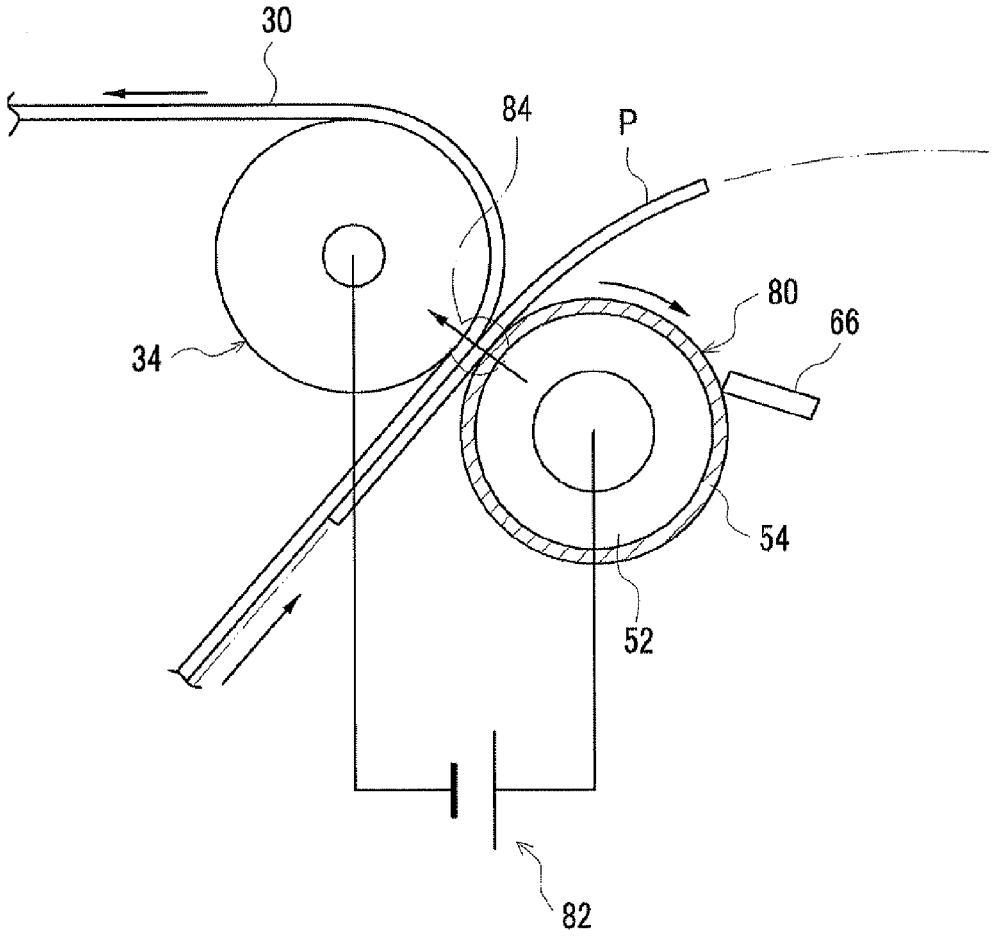
FIG. 6 is a side view showing the vicinity of a secondary transfer roller provided in the image forming apparatus related to the comparative form for comparing with the image forming apparatus related to the exemplary embodiment of the invention.
Figure 7:
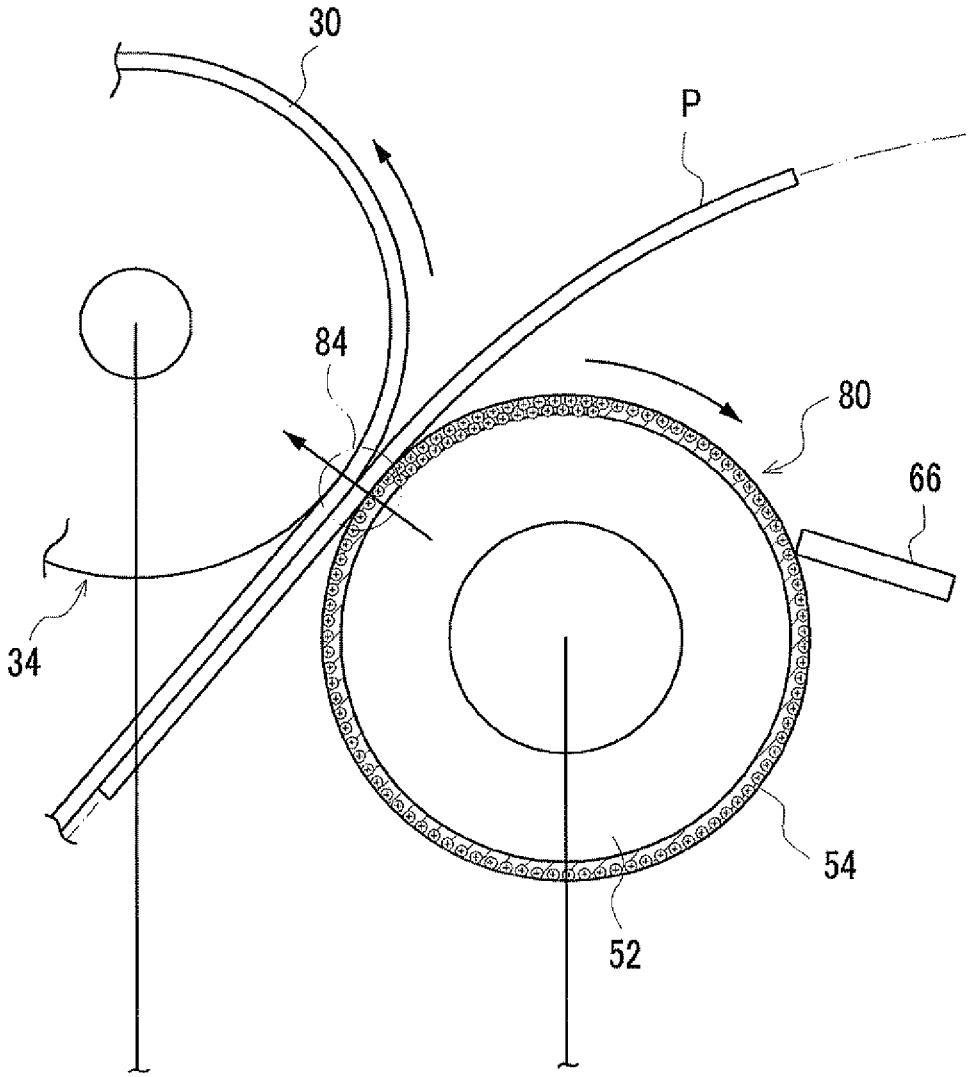
FIG. 7 is a side view showing the vicinity of the secondary transfer roller provided in the image forming apparatus related to the comparative form for comparing with the image forming apparatus related to the exemplary embodiment of the invention.

As shown in FIGS. 6 and 7, in the comparative form, the conductive member 58 (refer to FIG. 1) is not used, and a power source 82 is provided to apply a voltage between a secondary transfer roller 80 having the high-resistance layer 54 on the surface thereof, and the back-up roller 34, and to pass a transfer current between the secondary transfer roller 80 and a back-up roller 34.

In this the comparative form, when a voltage is applied by the power source 82, in the facing portion 84 where the secondary transfer roller 80 and the back-up roller 34 face each other, a current (transfer current) flows to the back-up roller 34 through the sheet member P and the intermediate transfer belt 30 from the secondary transfer roller 80 (refer to an arrow in the drawing).

A toner image formed on the intermediate transfer belt 30 and charged with a negative voltage is transferred to the sheet member P by an electrostatic attractive force as a transfer current flows to the back-up roller 34 from the secondary transfer roller 80.

Here, in the high-resistance layer 54 of the facing portion 84, the high-resistance layer 54 is formed from a high-resistance member. Therefore, electric discharge is suppressed, and the high-resistance layer 54 of the facing portion 84 is charged with a positive voltage. A charged portion of the high-resistance layer 54 moves to the downstream side in the rotational direction of the secondary transfer roller 36 with the rotation of the secondary transfer roller 36, and reaches the facing portion 84 in a charged state without being neutralized.

Similarly to the above, the high-resistance layer 54 of the facing portion 84 is charged with a positive voltage. That is, the amount of charging of the high-resistance layer 54 increases with time (rotation). For this reason, as shown in FIG. 3, the transfer current of the comparative form will decrease whenever time passes.

Figure 8:
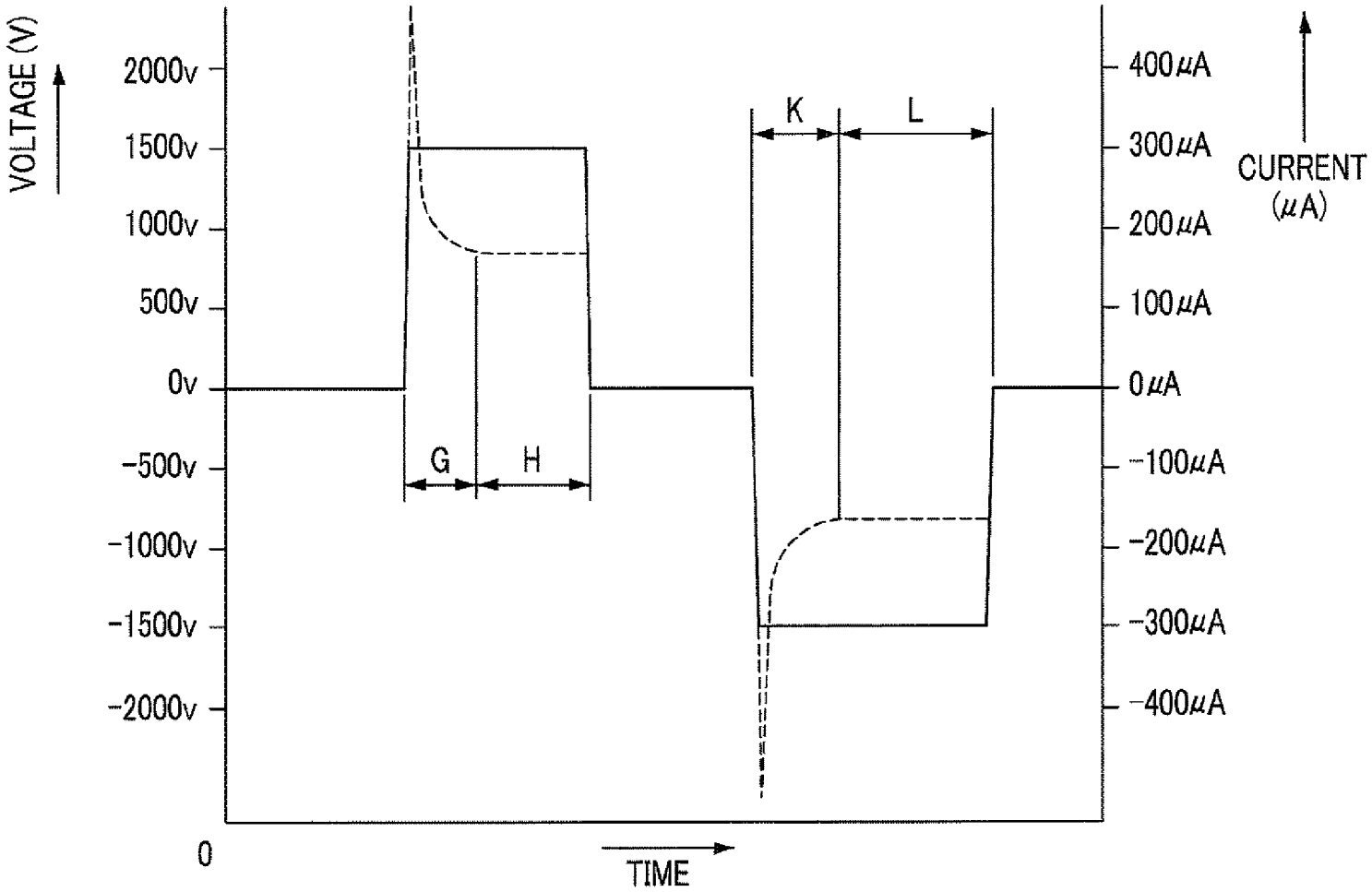
FIG. 8 is a graph showing the applied voltage and current of the image forming apparatus related to the comparative form of the invention.

Similarly to FIG. 4, a graph where the vertical axis represents voltage (V) and current (μA) and the horizontal axis represents time is shown in FIG. 8. In this graph, the voltage is shown by a solid line, and the current that is an evaluation results in the comparative form is shown by a dotted line.

As can be seen from the evaluation results shown in this graph, when the voltage of +1500 V is applied by the power source 82, the current for a first certain period of time (G in the drawing) decreases while the rate of change thereof decreases with the passage of time, and the current of 200 μA flows constantly in the next certain period of time (H in the drawing). Additionally, when the voltage is set to 0 V, the current becomes 0 μA, and when the voltage of −1500 V is applied, the current for the first certain period of time (K in the drawing) decreases while the rate of change thereof decreases with the passage of time, and the current of −200 μA flows constantly in the next certain period of time (L in the drawing).

The reason why the current decreases while the current of rate of change thereof decreases with time and the current flows constantly in the next certain period of time will be described (estimation mechanism).

As the high-resistance layer 54 used in the present exemplary embodiment and the comparative form, as mentioned above, the polyimide layer (PI layer) is used and resistance adjustment is performed with carbon black (CB). For this reason, the resistance of the high-resistance layer 54 has voltage dependability.

As mentioned above, the resistance of the high-resistance layer 54 is $10^{13.7}$ Ω·cm at the measurement of 100 V. However, the resistance of the high-resistance layer 54 is $10^{13.2}$ Ω·cm at the measurement of 500 V, $10^{12.2}$ Ω·cm at the measurement of 750 V, and $10^{10}$ Ω·cm at the measurement 1000 V, which are significant in falling characteristics at high voltages.

The neutralization time of a charged body is generally treated as a time constant, the time constant is large in proportion to resistance, and substantial time is required for neutralization. In this example, neutralization proceeds when the high-resistance layer 54 is greatly charged, and substantial time is required for the neutralization when charging becomes small by the neutralization. For this reason, in the comparative form, charging is integrated by the rotation of the secondary transfer roller 80. However, it is considered that, as charging becomes high, neutralization proceeds, and balance (saturation) is reached with an almost constant charging.

As can be seen from the above description, the high-resistance layer 54 used in the present exemplary embodiment and the comparative form is a layer including resistance at which charges on the surface and inner surface of the high-resistance layer 54 cannot be coupled while the secondary transfer roller 36 or 80 makes one rotation. That is, the high-resistance layer 54 is a layer having a resistance characteristic that is not neutralized even if the secondary transfer roller 36 or 80 goes around if the conductive member 58 is not used, unlike the present exemplary embodiment, and is also dependent on the rotational frequency, the size of the roller, and the like.

As described above, in the secondary transfer roller 36 related to the present exemplary embodiment, a current flows to the secondary transfer roller 36 from the conductive member 58 in the contact portion 62. Thus, the charged portion of the high-resistance layer 54 is neutralized. For this reason, the fluctuation of the transfer current that flows between the secondary transfer roller 36 and the back-up roller 34 is suppressed.

Additionally, since the fluctuation of the transfer current is suppressed, poor transfer of a toner image to the sheet member P is suppressed.

Additionally, since the secondary transfer roller 36 is provided with the elastically deformable elastic layer 52, as compared to a case where there is no elastic layer 52, a nipping force that is produced between the back-up roller 34 and the secondary transfer roller 36 to nip the intermediate transfer belt 30 and the sheet member P is stabilized.

Additionally, the cleaning blade 66 is provided on the downstream side of the facing portion 60 in the rotational direction of the secondary transfer roller 36, and on the upstream side of contact portion 62 in the rotational direction of the secondary transfer roller 36. For this reason, contamination of the conductive member 58 is suppressed.

Additionally, since the conductive member 58 rotates to follow the rotation of the secondary transfer roller 36, as compared to a case where the conductive member does not rotate to follow, the resistance produced between the secondary transfer roller 36 and the conductive member 58 is suppressed.

Additionally, since the resistance of the high-resistance layer 54 has voltage dependability, a voltage applied in order to pass a required current is made small.

In addition, although the specific exemplary embodiment of the invention has been described in detail, the invention is not limited to this exemplary embodiment, and it is apparent to those skilled in the art that other various embodiments may be made within the scope of the invention. For example, in the above exemplary embodiment, the back-up roller 34 and the secondary transfer roller 36 are provided nipping the intermediate transfer belt 30 therebetween. However, the intermediate transfer belt may not be particularly nipped. For example, the configuration of the present exemplary embodiment may be used for a transfer roller or the like that rotates to follow a photoreceptor (direct transfer or primary transfer) may be used.

Additionally, in the above exemplary embodiment, a voltage is applied to the conductive member 58 and the back-up roller 34. However, for example, a voltage may be applied to the cleaning blade 66 and the back-up roller 34.

Additionally, in the above exemplary embodiment, the high-resistance layer 54 is provided on the surface of the secondary transfer roller 36. However, the high-resistance layer may be at a position that may suppress the flow of a current in the direction of the rotary shaft, without being particularly limited to the surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer member that has a core and a high-resistance layer;

a facing member that is arranged to face the transfer member so as to sandwich an object to be transferred in cooperation with the transfer member;

a contact member that is arranged so as to be capable of contacting the transfer member; and a voltage application unit that applies a voltage between the contact member and the facing member, to pass a transfer current between the transfer member and the facing member, such that the core is electrically floated, wherein the contact member is placed at a position opposing the facing member.

2. The image forming apparatus according to claim 1, wherein the transfer member having an elastic layer, and the high-resistance layer is provided on a surface of the elastic layer.

3. The image forming apparatus according to claim 2, wherein the diameter of the core is 5 mm to 30 mm, and the thickness of the high-resistance layer is 0.001 to 1 mm.

4. The image forming apparatus according to claim 2, wherein the elastic layer contains foamed polyurethane.

5. The image forming apparatus according to claim 2, wherein the contact member is a columnar conductive member that rotates to follow the rotation with the transfer member, and has conductivity.

6. The image forming apparatus according to claim 1, wherein the diameter of the core is 5 mm to 30 mm, and the thickness of the high-resistance layer is 0.001 to 1 mm.

7. The image forming apparatus according to claim 1, wherein the high-resistance layer contains polyamide.

8. The image forming apparatus according to claim 1, wherein the contact member is a columnar conductive member that rotates to follow the rotation with the transfer member, and has conductivity.

9. The image forming apparatus according to claim 1, wherein the core is not grounded.

10. The image forming apparatus according to claim 1, wherein a material used to form core of the transfer member is SUS.

11. The image forming apparatus according to claim 1, wherein the high-resistance layer of the transfer member has voltage dependability.

* * * * *